United States Patent [19]

Vabrinskas

[11] 4,171,580

[45] Oct. 23, 1979

[54] BOOT DRYER

[76] Inventor: Vincent Vabrinskas, 879 Niagra St., Elmont, N.Y. 11003

[21] Appl. No.: 841,308

[22] Filed: Oct. 12, 1977

[51] Int. Cl.[2] ..... F26B 25/00

[52] U.S. Cl. ..... 34/104; 34/239; 34/243 R; 219/389

[58] Field of Search ..... 34/103, 104, 105, 21, 34/239, 243 R, 202; 98/56, 57; 36/2.6; 219/202, 387; 248/340, 215

[56] References Cited

U.S. PATENT DOCUMENTS

| | | | |
|---|---|---|---|
| 2,209,054 | 7/1940 | Doud et al. | 34/243 R |
| 3,624,346 | 11/1971 | Guth | 219/202 |
| 3,792,804 | 2/1974 | Ponzo | 248/340 |
| 3,808,401 | 4/1974 | Wright et al. | 219/387 |

FOREIGN PATENT DOCUMENTS

| | | | |
|---|---|---|---|
| 1214681 | 4/1960 | France | 34/104 |
| 1329890 | 5/1963 | France | 34/239 |

*Primary Examiner*—James C. Yeung
*Attorney, Agent, or Firm*—Robert D. Farkas

[57] ABSTRACT

A boot dryer utilizes a housing having an ingress port and an egress port and a low current consuming motor driven fan therein. A pair of flexible hoses are removably secured to the ports of the housing and extend downwardly therefrom when the housing is supported by a wire-like hook pivotably secured to the uppermost regions of the housing. The hook is extensible in length facilitating and supporting the housing depending downwardly therefrom. The free end of the flexible hoses, removably secured to the ports of the housing, are cut so as to form an angle to the longitudinal axis of the hoses. In use, the hoses are inserted into a pair of boots exposed in side by side relationship and a slow cool flow of air enters one boot and circulates upwardly through one hose and through the housing and then downwardly through the other hose, exiting outwardly from the remaining boot, thus drying the boot without cracking or deteriorating the interior of the boot. A timer may be utilized in conjunction with an on-off operating switch. Power is derived from household utility sources or a low voltage direct current supply.

8 Claims, 5 Drawing Figures

BOOT DRYER

BACKGROUND OF THE INVENTION

1. The Field of the Invention

This invention relates to boot dryers and more particularly to the class thereof utilizing cool air for the drying operation.

2. Description of the Prior Art

The prior art abounds with a variety of boot drying apparatuses. U.S. Pat. No. 2,465,362 issued March 29, 1949, to S. C. Elliott teaches a boot dryer having a plenum chamber in which a light bulb is mounted. A pair of elongated hollow tubes are removably secured to the uppermost region of the plenum chamber and are utilized to support a pair of boots thereon. The heated air, derived from the light bulb, drys the boots by circulating such air through the boots utilizing convection processes. This apparatus suffers the deficiency of having a very low flow of air through the boots, and such heat is inefficiently derived from the lamp bulb, which generates light rays which are not effective in the boot drying process.

U.S. Pat. No. 2,076,735 issued on Apr. 13, 1937 to J. P. Leindorf discloses a shoe drying attachment utilizing a hairdryer apparatus providing heated forced air driven through an anvil-like device inserted into the interior of the shoe and containing an opening of the toe most region of the anvil. Such apparatus requires a substantial amount of electrical energy to operate the drying device and provides only heated air which tends to cause the boot materials to crack, shrink, and otherwise deteriorate during the rapid and destructive drying operation.

U.S. Pat. No. 3,793,744 issued on Feb. 26, 1974 to Y. Saita describes a device for directly drying the inside of shoes, such as bowling shoes, or golf shoes, which consists of a drying box provided with an external heater, a serpentine air inlet pipe within the box connected to said heater and provided with a plurality of perforated nozzles on which said shoes may be hung. This device further includes a valve which tends to open when the nozzles are disposed in a horizontal position such as when said shoe is disposed about the nozzle portion of the apparatus. However, such device is totally unacceptable for drying large boots, such as knee high devices because of the shortened shape of the perforate nozzle and furthermore tends to provide variable amounts of heated air flows within the shoe which is destructive for the life of the shoe repeatedly dried utilizing the Saita apparatus.

SUMMARY OF THE INVENTION

A primary object of the present invention is to provide a boot dryer which dries boots without deteriorating the boot material.

Another object of the present invention is to provide a boot drying device which consumes a minimum of electrical energy when in use.

Still another object of the present invention is to provide a boot dryer suitable for convenient mounting when used in a variety of locations in the field.

Yet another object of the present invention is to provide a boot dryer which is totally portable in nature and easily adapted to boots of various constructions without requiring a range of attachments therefor.

A further object of the present invention is to provide a boot dryer which may be economically constructed and totally effective in use.

Another object of the present invention is to provide a boot dryer whose electrically operated components may be operated from household utility voltage or from a vehicle for battery, thus enhancing the ability to use the apparatus indoors or in field use.

Heretofore, boot dryers were of the class that enabled the dryer to be utilized primarily employing a source of heated air so as to enhance the speed of the drying operation. I have discovered that such heated air tends to deteriorate the boot materials when used in a rapid drying operation. This is particularly true of insulated boots, now common in outdoor use. Part of the problem relates to permanent deterioration of the shoe material whilst the remaining problems center about the generation of salt-like coatings on the interior of the boot. Boot materials, of a wide range, contain salts either purposefully combined with the boot materials in the manufacturing process or disposed coating the interior of the boot stemming from the feet of the user resulting from perspiration and articles of foot attire, such as stockings or the like. During the rapid drying process, heretofore popular, such salts tend to form a coating on the interior of the shoe further limiting the drying process and resulting in an offensively abrasive material which degrades the shoe lining. A user who wears such a rapidly dried boot soon experiences irritation and finds that the boot tends to remain moist due to the salt moisture barrier formed because of the heated air causing the salt to deposit on the interior of the boot. Slow drying enhances crystalline growth of the salt-like materials such that such salt crystals create finger-like structures extending inwardly from the boot leaving large patches of boot material free from salt deposits. Since the salt-like fingers are brittle in nature, brisk rubbing or passing one's hand within the dried out boot, followed by shaking the boot, totally removes all the accumulated salt after a slow drying process. Thus, a slowly dried shoe is not only comfortable to wear but remains dry for extended periods of time of usage and has a greater useful life. Furthermore, cool air is far more easily generated than warm air. Longer drying, useful in generating the salt crystals, enables a boot dryer of the class herein described to utilize a low power motor. I have discovered that a three watt motor, either operating from household utility voltage sources or 12 volt batteries, such as those frequently found in motor vehicles, suffices for a boot drying operation consuming some 3 to 5 hours of time for boots some 14 inches high of even the largest sizes. Furthermore, since users tend to utilize boots that extend in height from the ankle region to the knee region, or even higher, a flexible-like duct, partially collapsible in nature, may be utilized to extend within the shank of boots of varying heights. By being flexible, such hose-like tubes may even have the free ends thereof turned so as to point towards the toe of the boot when being inserted into the foot receiving portion of the boot. By cutting the free ends of the hose-like tubes at an angle approximating 45 degrees, air may be directed towards the interior of the foot portion of the boot when the free end of the tube is disposed adjacent the heel area of the boot and above the interior sole thereof. Since the apparatus is intended for both indoor and outdoor usage, a J-like hook is attached to the uppermost region of the apparatus, which has an extensible length thereby permitting the housing portion of the apparatus to be suspended over boots of varying heights, at any convenient location over the floor, supporting the boots thereon. Air tends to enter the foot receiving portion of one boot, passing through an intake tubing into the housing carrying a fan, and then outwardly through the other tube into the interior of the other boot, exiting therefrom into the atmosphere. The boot second in line to the boot receiving air from the atmosphere tends to receive more moisture ladden air than the atmospheric air receiving boot. However, due to the lengthened drying process, both boots finish up perfectly dry and never generate salt-like coatings on the interior, nor do they suffer deterioration similar to the deterioration frequently encountered when using hot air, high volume boot dryers of the prior art.

These objects as well as other objects of the present invention, will become more readily apparent after reading the following description of the accompanying drawings.

DESCRIPTION OF THE PREFERRED EMBODIMENT

Figure 1:
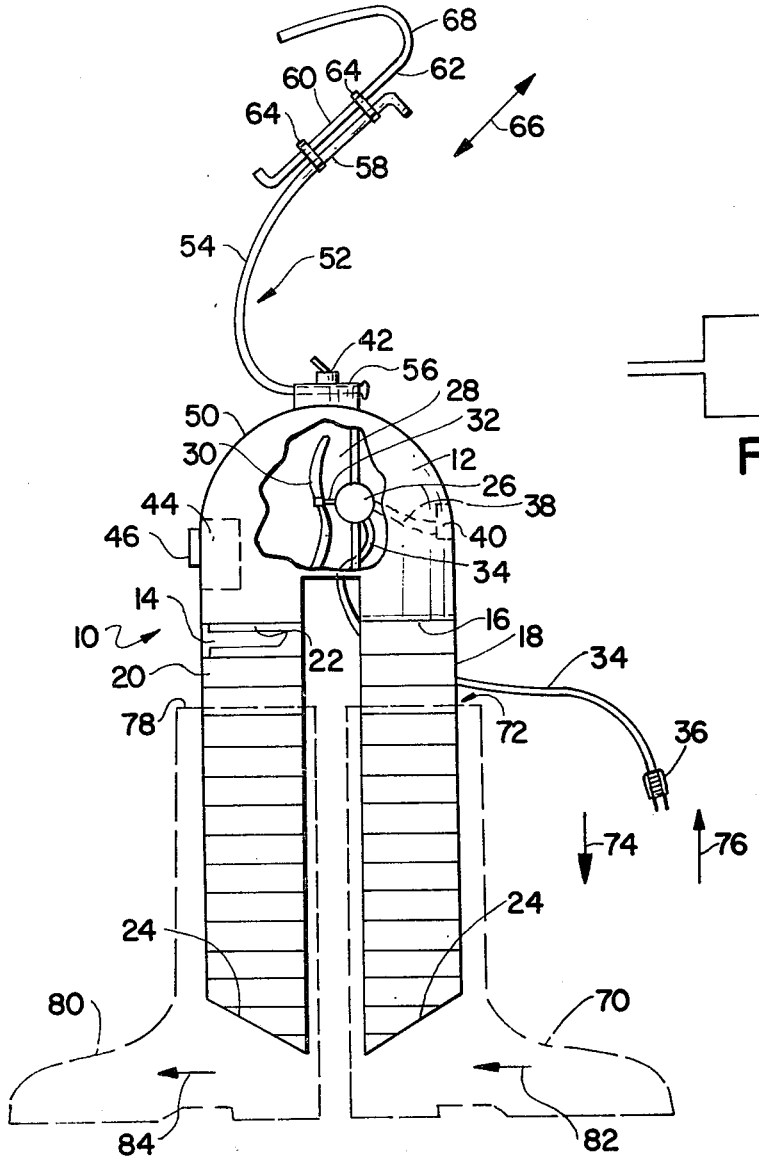
FIG. 1 is a plan view of the present invention shown in conjunction with a pair of boots.

A housing, fabricated from a plastic material such as polystyrene, is utilized having a motor driven fan disposed therein pneumatically coupled in between an ingress port and egress port. Such ports are disposed residing substantially in a common plane intended to be located below the housing when the housing is supported in a use position by a wire-like J-hook assembly carrying the housing. The hook utilizes a first member pivotably secured to the housing in the uppermost region thereof. A second hook portion is slideably attached to a portion of the first hook portion, utilizing a pair of clamps therefor. Both overlaping hook portions are frictionally engaged to one another by the pair of clamps and extensively couple both hook portions together. The second hook portion contains a hook-like end for hanging from a structure, such as horizontal rod in a clothes closet, a door knob, the limb of a tree, or the door handle of a motor vehicle. The hook portions may be fabricated from steel or plastic as desired. The fan is disposed in the mid-regions of the housing, which has a substantially inverted U-like shape wherein the ingress port and the egress port are located in the lowermost portions of the leg of the U-shaped cross sectioned housing. Such ports are circular in nature and have a shoulder region thereon immediately adjacent the open mouth regions of the ports. A pair of flexible hoses, preferably fabricated from a plastic material, such as polyethelene, is disposed removably secured to the shoulders adjacent the open mouth regions of the ports. The flexible tubing may contain wire-like helical supporting rods disposed within the tubing or, if desired, within the walls of the tubing so as to reinforce same against accidental crushing. The lowermost ends of the tubing, when the tubing is attached to the housing, are cut at a 45 degree angle or at any other angle desired so as to direct the air angularly from the longitudinal axes of the tubing when the tubing is maintained in a vertical position hanging downwardly from the housing. The fan, located in the housing, is driven so as to cause the air to enter one tubing into the housing and emerge outwardly from the housing into the other tubing. The angular cut ends of the tubing may be disposed facing each other, facing outwardly from each other or facing in the same general direction, thus determining the placement of the boots there around such that the portion of the boots are in line with the face of the cut ends of the tubing. The motor is disposed in a series electrical circuit with an operating switch, also carried by the housing. If desired, a timer may be installed in a series circuit with the operating switch such that the output circuit of the timer, comprising a pair of switched contacts, provide timed operating current for the motor which drives the fan blade of any convenient design. The motor may be of a design which is operated from household utility voltages or, if desired, may be of the variety which can be operated from a low voltage direct current source, such as a motor vehicle battery. Alternately, an apparatus such as a stepdown transformer and a bridge rectifier may be employed so as to operate a direct current motor from household utility current when desired, and from a low voltage direct current source coupled directly to the motor. One version of the present invention may employ a line cord, having a cigarette lighter plug at one end thereof and a receptacle at the other end thereof engagable to a plug attached to the housing such that such plug is connected directly to the direct current side of the bridge rectifier. The line cord, used to carry household utility current to the transformer, similarily carried by the housing, may also be removably attached to the circuit or may be permanently affixed to the primary terminals of the transformer. The timer may be carried by the housing having a construction well known to the art, including, if desired, a mechanically rotated arm indicating the time elapsed during the time cycle of the timer, extending outwardly of the housing. Thus, various combinations of circuitries may be employed including household utility voltage or direct current supplies, timed or untimed span of operation, removable cables, plugs and receptacles for household supply or direct current supplies, or combinations of all of these.

Now referring to the figures, and more particularly to the embodiment illustrated in FIG. 1 showing the present invention 10 having housing 12 including egress port 14 and ingress port 16. Flexible tubing 18 is secured to ingress port 16 whilst egress port 14 has flexible tubing 20 secured thereto and removably clamped onto shoulder 22. Another shoulder, not shown, permits tubing 18 to be removed from housing 12 when desired. Ends 24 of tubes 18 and 20 are shown cut at an angle relative to the longitudinal axes thereof. Motor 26 is shown as within cavity 28 of housing 12, shown carrying fan 30 on the output shaft 32 thereof. Wire 34 is shown coupled to plug 36 adapted for use with a conventional source of household utility voltage. Dotted lines 38 are shown coupling the motor to receptacle 40, carried by housing 12. On-off toggle switch 42 is shown carried by housing 12 and is electrically coupled in series with motor 26 and the conductors of cable 34 by wires not shown. Timer mechanism 44, shown within dotted lines, has timer dial 46 disposed on the exterior surface 50 of housing 12. J-hook 52 is shown having portion 54 thereof pivotably secured to housing 12 by having a portion thereof passing through lock 56 secured to housing 12. End 58 of J-hook portion 54 is shown slideably engaged with end 60 of hook portion 62, utilizing encircling clamps 64 to permit portions 54 and 62 to slide along in the direction of arrows 66 when opposite forces are directed on the hook portion. End 68 of hook portion 62 is provided with a hook-like end so as to support housing 12 in the position shown.

Dotted lines 70 illustrate a boot in which air enters the open mouth portion 72 and passes downwardly in the direction of arrow 74 into boot 70. Air then passes upwardly in the direction of arrow 76 through tube 18. Air emerges outwardly and downwardly through tube 20 in the direction of arrow 74 so as to exit open mouth portion 78 of the boot depicted by dotted line 80 by passing upwardly in the interior of boot 80 in the direction of arrow 76. Beveled ends 24 of tubes 18 and 20 causes air to pass in the direction of arrow 82 in the boot shown by dotted lines 70 and air to move in the direction of arrows 84 in the boot depicted by dotted lines 80.

Figure 2:
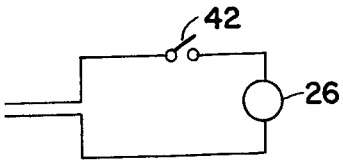
FIG. 2 is an electrical schematic of the present invention.

FIG. 2 illustrates switch 42 in a series electrical circuit with motor 26. Such circuit is suitable for operation on either household utility voltage or a low voltage direct current source, not shown.

Figure 3:
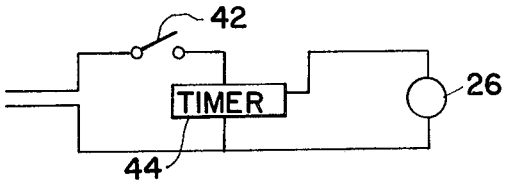
FIG. 3 is an alternate electrical schematic utilizable in the present invention.

FIG. 3 illustrates switch 42 in a series electrical circuit with timer 44 shown controlling and providing operating power to motor 26. Again, motor 26 may be operated from a low voltage source or a household utility voltage source, as desired.

Figure 4:
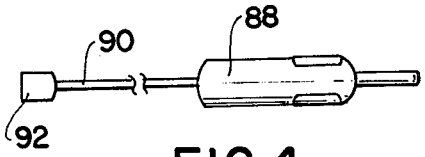
FIG. 4 is a side elevation view of an electrical cord, plug and socket arrangement utilized with the apparatus shown in FIG. 1.

FIG. 4 illustrates a cigarette lighter plug 88 coupled to electrical cable 90, terminating in receptacle in plug 92, suitable for attachment with receptacle 40, shown in FIG. 1.

Figure 5:
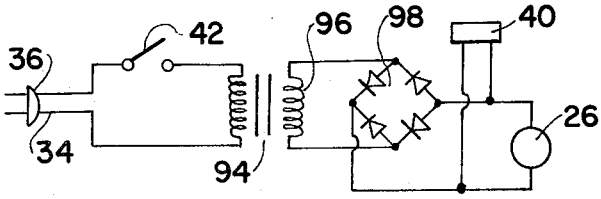
FIG. 5 is an alternate embodiment of an electrical schematic of the present invention.

FIG. 5 illustrates switch 42 in series with cable 34 and plug 36 and transformer 94. Secondary 96 of transformer 94, operates bridge rectifier 98 so as to produce a low voltage direct current source for motor 26. Receptacle 40 is shown electrically coupled to the direct current side of bridge rectifier 98 and motor 26. Thus, motor 26 may be operated from direct current, provided to receptacle 40, or alternating current, provided to cable 34.

One of the advantages of the present invention is a boot dryer which dries boots without deteriorating the boot material.

Another advantage of the present invention is a boot drying device which consumes a minimum of electrical energy when in use.

Still another advantage of the present invention is a boot dryer suitable for convenient mounting when used in a variety of locations in the field.

Yet another advantage of the present invention is a boot dryer which is totally portable in nature and easily adapted to boots of various constructions without requiring a range of attachments therefor.

A further advantage of the present invention is a boot dryer which may be economically constructed and totally effective in use.

Another advantage of the present invention is a boot dryer whose electrically operated components may be operated from household utility voltage or from a vehicle or battery, thus enhancing the ability to use the apparatus indoors or in field use.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A boot dryer comprising a housing, an electrical motor operated fan, said fan being disposed within said housing, said housing having an ingress port and an egress port, said ingress port and said egress port being disposed in a common plane, a pair of hollow tubes, said pair of hollow tubes having one end of each removably coupled to said ingress port and said egress port, said pair of tubes each having the free end thereof disposed forming an acute angle to the longitudinal axes of each of said pair of tubes, said free ends defining a pair of openings communicating to the interior of said pair of tubes, said pair of openings each residing in intersecting planes, said intersecting planes intersecting at a line intermediate said longitudinal axes, each of said longitudinal axes of said pair of tubes being disposed parallel to one another and transverse to said common plane, a switch, a line cord, said switch and said line cord being disposed in a series electrical circuit with said electrical motor, a wire-like hook element, one end of said wire-like hook element pivotably secured to said housing, the other end of said wire-like hook element being disposed having a hook-like portion, said wire-like hook element being extensible in length, said intersecting planes extending upwardly and outwardly from said line and said common plane being disposed below said housing when said housing is supported by said wire-like hook.

2. The apparatus as claimed in claim 1 wherein said housing comprises polystyrene.

3. The apparatus as claimed in claim 1 further comprising said ingress port and said egress port residing in a horizontal plane when said housing is supported by said wire-like hook.

4. The apparatus as claimed in claim 1 further comprising a timer, said timer being disposed in series with said motor and electrically controlled by said operating switch.

5. The apparatus as claimed in claim 1 further comprising a cigarette lighter plug, a cable, a plug, said cigarette lighter plug and said cable and said plug all disposed in a series electrical circuit, a receptacle, said receptacle electrically coupled to said motor and carried by said housing, said plug being removably coupled to said receptacle, when said motor is operated by a low voltage direct current source when said plug is inserted in said receptacle and said cigarette lighter plug is electrically coupled to said low voltage source.

6. The apparatus as claimed in claim 1 further comprising a transformer, a bridge rectifier, said transformer being disposed electrically coupled to said switch, the secondary of said transformer being disposed electrically coupled to said bridge rectifier, said bridge rectifier electrically coupled to said motor, a receptacle, said receptacle electrically coupled to said motor and said bridge rectifier, whereby said switch and said transformer when electrically coupled to a source of voltage provides direct current to said motor when said switch is in a closed circuited condition and whereby said receptacle when coupled to a source of direct current operates said motor.

7. The apparatus as claimed in claim 1 wherein said pair of tubes comprise flexible hollow tubing.

8. The apparatus as claimed in claim 7 wherein said tubing is disposed along a vertical line when said housing is disposed supported by said wire-like hook.

* * * * *